United States Patent [19]

Clayfield et al.

[11] 4,090,853

[45] May 23, 1978

[54] COLLOIL PRODUCT AND METHOD

[75] Inventors: Eric J. Clayfield, Mickle Trafford, near Chester; Ernest C. Lumb, Chester; Kenneth J. Wilbraham, Upton-by-Chester, all of England

[73] Assignee: Shell Oil Company, Houston, Tex.

[21] Appl. No.: 735,360

[22] Filed: Oct. 26, 1976

[30] Foreign Application Priority Data

Oct. 29, 1975 United Kingdom ..... 44639/75

[51] Int. Cl.[2] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,431,225 | 10/1922 | Greenstreet | 44/51 |
| 2,590,733 | 3/1952 | Stillman | 44/51 |

FOREIGN PATENT DOCUMENTS

| | | | |
|---|---|---|---|
| 458,486 | 6/1936 | United Kingdom | 44/51 |

*Primary Examiner*—Allen B. Curtis

[57] ABSTRACT

A novel coal and liquid hydrocarbon fuel product, and a method for making the product, are disclosed.

5 Claims, No Drawings

COLLOIL PRODUCT AND METHOD

BACKGROUND OF THE INVENTION

In the past, fluid fuels containing solid carbon particles have been made as a result of the availability of powdered coal. Coal mixed with a hydrocarbon fuel constitutes a combustible mixture having very satisfactory combustion properties. The addition of water to the mixture in amounts which do not exceed the amount of the main constituents has proved to contribute to the combustion efficiency of such a fuel, see, e.g., U.S. Pat. No. 1,431,225.

The use of such fuels appears imminent as a means of exploiting plentiful supplies of coal. However, a problem associated with such fuels relates to the requirement that they be stored in bulk for long periods, particularly in the case where such fuels are used for firing boilers in power stations or marine applications.

Accordingly, the invention has for its object the provision of a fuel product substantially composed of a liquid hydrocarbon fuel, finely divided coal particles suspended therein, and water, such a product being stable for a storage time of up to four months and longer.

SUMMARY OF THE INVENTION

Briefly, the invention relates to such a fuel product and a method of making the fuel product comprising, mixing coal of a grain size not greater than about 6 mm. with an amount of water not greater than 30% by weight, based on the weight of the coal; mixing the wetted coal with fuel, the amount of coal being controlled so that the mixture contains not more than 50% by weight of coal, based on the weight of the coal and fuel, and milling or grinding the mixture thus formed to produce a fluid fuel containing coal particles of not greater than 500 microns in size.

DETAILED DESCRIPTION OF THE INVENTION

The water and coal must be mixed before the addition of the oil, in order that the desired form of the product may be obtained, i.e., a flocculated structure in oil of the coal particles in which water preferentially wets part of the surface of each coal particle and links it to other coal particles. If the mixing is carried out otherwise, as for example, as described in previously mentioned U.S. Pat. No. 1,431,225, an emulsion of water in the oil is formed, the coal particles are not wetted by the water, and the product is stabilized to a much smaller extent against settling.

The mixing of the coal and water is preferably carried out in a screw mixer, which facilitates continuous mixing and transport thereof. The mixer is preferably kept at a temperature of from about 75° to about 95° C. This temperature range is optimal in regard to the viscosity of the constituents to be mixed therein.

A wide range of fuel oils, from about 200 seconds to 6000 Redwood I or more may be used, and both normal residues and cracked residues may be included. A preferred hydrocarbon oil for making the mixture is an oil of 3500 seconds Redwood I.

In general, coals of ash content greater than about 20% are not economically attractive, and there may also be difficulty in applying water stabilization to coals of very high ash content.

The larger wet coal mills are limited in feed grain size to about 6mm, and in smaller mills the grain size has a maximum of 3 mm; this maximum is a function of the method of grinding and of the brand of mill. The lower limit on particle size is in practice not critical; crushed coal contains 90% greater than 200 microns, and the limiting factor in practice is dust nuisance.

The particle size distribution after grinding is determined by the application. For boiler firing, burner nozzle orifices limit the maximum to about 500 microns, but the coal may be coarser for blast furnace injection. Almost all the particles are larger than 10 microns; a wide particle size range may be beneficial in lowering the viscosity of the product.

In any event, the coal needs to be wetted by the water for stabilization to occur. Adding water to the suspension of coal in oil simply forms an emulsion in the oil which does not aid stability for a long duration. Since the achievement of stability to settling depends on the degree of wetting of the coal, high-ash coals or lignites, which are more easily wetted by water, will be better stabilized by the further addition of small amounts of surfactants, such as anionic surfactants. The rate of settling in some formulations may be decreased if the viscosity of the aqueous phase is increased by the addition of small amounts of a high molecular weight, water-soluble polymer, e.g., polyethylene oxide.

Fuel transport from the storage vessel to the burner will be facilitated when the storage vessel is kept at a temperature of about 50° C to about 60° C.

EXAMPLE

Batches of coal-oil mixtures stabilized with water were prepared according to the invention in a commercial toothed colloid mill as follows:

| No. | coal / coal + oil % w | water / coal + water % w | Coal % w | Oil % w | Water % w |
|---|---|---|---|---|---|
| 1 | 40 | 30 | 34.1 | 51.3 | 14.6 |
| 2 | 40 | 20 | 36.4 | 54.5 | 9.1 |
| 3 | 40 | 10 | 38.3 | 57.4 | 4.3 |
| 4 | 45 | 20 | 40.4 | 49.5 | 10.1 |

Settling rates and viscosities of these materials are compared with those of: No.

5 A water-free 40/60 coal-oil mixture, prepared in the colloid mill.

6 A water-free 40/60 coal-oil mixture prepared by mixing pulverized fuel of a normal commercial grade with oil.

7 A water-containing coal-oil mixture of the same composition as No. 2, and different only in that the water was added to the slurry of coal in oil before grinding instead of the method of mixing coal and water and adding the coarse wet coal to the oil before grinding.

The settling rates and viscosity of the various samples are as follows:

| No. | Rate of settling of centre of gravity of coal, mm/day at 30° C | Viscosity, at shear rate of $4.6s^{-1}$ poise, 30° C |
|---|---|---|
| 1 | 2 | 130 |
| 2 | 3 | 119 |
| 3 | 18 | 114 |
| 4 | 2 | 188 |
| 5 | 45 | 131 |
| 6 | 24 | — |

-continued

| No. | Rate of settling of centre of gravity of coal, mm/day at 30° C | Viscosity, at shear rate of $4.6s^{-1}$ poise, 30° C |
|---|---|---|
| 7 | 18 | — |

The results indicate that:

(a) 20% percent by weight of water, based on the weight of the coal, is sufficient to stabilize the mixture against settling at storage temperature;

(b) Excess water has only a small effect, (c) The coal must be wetted before adding it to the oil and grinding to achieve useful stabilization, (d) The effect of water on the viscosity of the product is small compared with the effect of additional coal.

We claim as our invention:

1. A method of making a fluid fuel product containing coal and a liquid hydrocarbon fuel comprising, mixing coal of a grain size not greater than about 6 mm. with an amount of water not greater than thirty percent by weight, based on the weight of the coal; mixing the wetted coal with liquid hydrocarbon fuel, the amount of coal being controlled so that the mixture contains not more than fifty percent by weight of coal, based on the weight of the coal and fuel; and milling the mixture thus formed to produced a fluid fuel containing coal particles not greater than about 500 microns in size.

2. The method of claim 1, wherein the coal and water are mixed at a temperature of from about 75° to about 95° C.

3. The method of claim 2, wherein the fuel is a 200–6000 seconds Redwood I oil.

4. The method of claim 3, wherein the fuel is a 3500 seconds Redwood I oil.

5. A fuel product containing coal and a liquid hydrocarbon fuel, and characterized by improved storage life, said product being formed by mixing coal of a grain size not greater than about 6 mm. with an amount of water not greater than thirty percent by weight, based on the weight of the coal; mixing the wetted coal with liquid hydrocarbon fuel, the amount of coal being controlled so that the mixture contains not more than fifty percent by weight of coal, based on the weight of the coal and fuel; and milling the mixture thus formed to produce in the fuel coal particles not greater than about 500 microns in size.

* * * * *